US011473160B2

(12) United States Patent
Mraczek et al.

(10) Patent No.: US 11,473,160 B2
(45) Date of Patent: Oct. 18, 2022

(54) COLD-ROLLED FLAT STEEL PRODUCT HAVING METAL ANTI-CORROSION LAYER AND METHOD FOR PRODUCING SAME

(71) Applicant: voestalpine Stahl GmbH, Linz (AT)

(72) Inventors: Klemens Mraczek, Traun (AT); Andreas Muhr, Linz (AT); Bernhard Haneder, Langenstein (AT)

(73) Assignee: VOESTALPINE STAHL GMBH, Linz (AT)

( * ) Notice: Subject to any disclaimer, the term of this patent is extended or adjusted under 35 U.S.C. 154(b) by 155 days.

(21) Appl. No.: 16/956,301

(22) PCT Filed: Dec. 18, 2018

(86) PCT No.: PCT/EP2018/085664
§ 371 (c)(1),
(2) Date: Jun. 19, 2020

(87) PCT Pub. No.: WO2019/121793
PCT Pub. Date: Feb. 7, 2019

(65) Prior Publication Data

US 2020/0325552 A1 Oct. 15, 2020

(30) Foreign Application Priority Data

Dec. 21, 2017 (DE) ..... 10 2017 223 633

(51) Int. Cl.
*C21D 8/02* (2006.01)
*C22C 38/00* (2006.01)
(Continued)

(52) U.S. Cl.
CPC ..... *C21D 8/0236* (2013.01); *C21D 8/0226* (2013.01); *C21D 8/0263* (2013.01);
(Continued)

(58) Field of Classification Search
CPC .. C21D 8/0226; C21D 8/0236; C21D 8/0263; C21D 8/0273; C21D 8/0426;
(Continued)

(56) References Cited

U.S. PATENT DOCUMENTS 3,420,760 A * 1/1969 Georgetti ..... C25F 7/00 205/711

FOREIGN PATENT DOCUMENTS

DE 10 2012 013 113 A1 12/2013
DE 10 2015 111 866 A1 1/2017
(Continued)

OTHER PUBLICATIONS

EP Office Action in Application No. 18 826 307.3-1103 dated Jul. 21, 2021.
(Continued)

*Primary Examiner* — Jenny R Wu
(74) *Attorney, Agent, or Firm* — Staas & Halsey LLP

(57) ABSTRACT

A method for producing a cold-rolled flat steel product coated with a metallic anticorrosion layer includes producing a steel melt containing in addition to iron and unavoidable impurities (in % by wt.): C: 0.01-0.35%, Mn: 1-4%, Si: 0.5-2.5%, Nb: to 0.1%, Ti: 0.015-0.1%, P: up to 0.1%, Al: to 0.15%, S: up to 0.01%, N: up to 0.1%, and optionally one or more elements from a group of rare earth metals. The method further includes casting the steel melt to give a preliminary product, hot-rolling the preliminary product to give a hot strip, coiling the hot strip to give a coil, annealing the hot strip, cold-rolling the annealed hot strip to give a cold-rolled flat steel product, finally annealing the cold-rolled flat steel product, and applying a metal anticorrosion layer based on zinc by electrolytic galvanization or hot dip galvanization of the cold-rolled and finally annealed flat steel product.

20 Claims, 5 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/20*** | (2006.01) |
| ***C22C 38/26*** | (2006.01) |
| ***C22C 38/30*** | (2006.01) |
| ***C22C 38/40*** | (2006.01) |
| ***C23C 2/06*** | (2006.01) |
| ***C25D 3/22*** | (2006.01) |

(52) U.S. Cl.

CPC ..... *C21D 8/0273* (2013.01); *C22C 38/001* (2013.01); *C22C 38/02* (2013.01); *C22C 38/04* (2013.01); *C22C 38/06* (2013.01); *C22C 38/14* (2013.01); *C22C 38/20* (2013.01); *C22C 38/26* (2013.01); *C22C 38/30* (2013.01); *C22C 38/40* (2013.01); *C23C 2/06* (2013.01); *C25D 3/22* (2013.01)

(58) Field of Classification Search

CPC .. C21D 8/0436; C21D 8/0463; C21D 8/0473; C21D 9/48; C22C 38/001; C22C 38/02; C22C 38/04; C22C 38/06; C22C 38/12; C22C 38/14; C22C 38/20; C22C 38/26; C22C 38/30; C23C 2/06; C23C 2/26; C23C 6/00; C23G 1/08; C25D 3/22; C25F 1/06

See application file for complete search history.

(56) References Cited

FOREIGN PATENT DOCUMENTS

| | | | | | |
|---|---|---|---|---|---|
| DE | 10 2015 112 886 | A1 | | 2/2017 | |
| DE | 10 2015 112 889 | A1 | | 2/2017 | |
| EP | 2383353 | A2 | | 11/2011 | |
| EP | 3 020 842 | | | 5/2016 | |
| EP | 3 027 784 | B1 | | 6/2016 | |
| EP | 3 080 322 | A4 | | 10/2016 | |
| EP | 3 146 083 | A1 | | 3/2017 | |
| EP | 3 219 821 | A1 | | 9/2017 | |
| EP | 3 146 083 | B1 | | 7/2018 | |
| EP | 3146083 | B1 | * | 7/2018 | ..... C21D 8/04 |
| JP | 2007-224416 | A | | 9/2007 | |
| JP | 2013-32582 | A | | 2/2013 | |
| JP | 2013032582 | A | * | 2/2013 | ..... C21D 8/0236 |

OTHER PUBLICATIONS

Bell S et al: "Final Report on Effect of Impurities in Steel", Final Report of Natural Resources Canada, Natural Resources Canada, Canada, Bd. Report No. 2005-41 (CF) 1. Mar. 2006 (Mar. 1, 2006), Seiten 1-25, XP009508207, DOI: 10.13140/RG.2.2.33946.85440 Gefunden im Internet: URL: https://www.researchgate.net/publication/306293969? channel=doi &linkld=57b 7 493708aec9984ff2a51 f &showFulltext=true **.

Written Opinion and International Search Report dated Feb. 14, 2019 in International Patent Application No. PCT/EP2018/085664.

Office Action dated Aug. 29, 2018 in German Patent Application No. 10 2017 223 633.7.

* cited by examiner

COLD-ROLLED FLAT STEEL PRODUCT HAVING METAL ANTI-CORROSION LAYER AND METHOD FOR PRODUCING SAME

CROSS REFERENCE TO RELATED APPLICATIONS

This application is filed under 35 U.S.C. §371 as a National Stage of International Application No. PCT/EP2018/085664, filed on Dec. 18, 2018, which claims the priority benefit of German Patent Application No. 10 2017 223 633.7, filed on Dec. 21, 2017. International Application No. PCT/EP2018/085664 and German Application No. 10 2017 223 633.7 are incorporated by reference herein in their entirety.

TECHNICAL FIELD

The disclosure relates to a method of producing a cold-rolled flat steel product that has been coated with a metallic anticorrosion layer and has a reduced tendency to absorb hydrogen during production and further processing, and to a cold-rolled, finally annealed flat steel product coated with a metallic anticorrosion layer.

BACKGROUND

It is known that atomic hydrogen can penetrate relatively easily into the material during the processing of steel and is highly mobile in the metal lattice of the material. The diffusible hydrogen accumulates at defects or grain boundaries in the metal lattice. As a result, embrittlement of the metal occurs, which is also referred to as hydrogen embrittlement.

Hydrogen embrittlement is akin to material fatigue, since the damage takes time. As a result, there can be hydrogen-induced cracking, and there is a risk of a delayed brittle fracture.

Developments in lightweight construction, for example for bodywork applications, are closely coupled to the rise in the use of AHSS (Advanced High Strength Steel) qualities. Steels of these high qualities are in many cases used in the galvanized state for anticorrosion reasons. However, there is no broad use as yet in the field of safety-relevant structures that are manufactured from cold-forming steels with the highest strengths owing to lack of clarity with regard to the problem of hydrogen embrittlement.

EP 3 020 842 A1 already discloses a flat steel product having an internal Si oxide or Mn oxide layer adjacent to the surface. The thickness of the Si oxide or Mn oxide layer is 4 μm or more. The thickness of the oxide layer is adjusted via the coiling temperature after the hot rolling operation. The oxide layer increases the hydrogen embrittlement resistance of the steel product.

DE 10 2008 057 151 A1 describes a method of producing an electrolytically galvanized high-strength steel. In the method, the cleaning steps needed for the electrolytic galvanization that are executed under the influence of current are performed with alternating current. By virtue of the rapid switch in polarization, it is possible to oxidize the atomic, diffusible hydrogen at the surface of the flat steel product to be coated and hence render it harmless.

EP 3 027 784 B1 describes a silicon-containing microalloyed high-strength multiphase steel having an Si content of not more than 0.8% by weight. The production of the steel optionally includes annealing of the hot strip and annealing of the cold strip.

SUMMARY

One objective underlying the disclosure can be considered that of producing a high-strength galvanized flat steel product having high resistance to hydrogen embrittlement, and hence of providing a product that is especially also suitable for use for safety-relevant structures for bodywork applications. A further aim of the disclosure is to specify a method for producing a zinc-coated flat steel product having high hydrogen embrittlement resistance.

According to an aspect of the disclosure, the objective can be achieved by a method of producing a cold-rolled flat steel product that has been coated with a metallic anticorrosion layer and has a reduced tendency to absorb hydrogen during production and further processing. The method comprises the following operating steps: producing a steel melt containing (in % by wt.): C: 0.01-0.35%, Mn: 1-4%, Si: 0.5-2.5%, Nb: up to 0.2%, Ti: up to 0.2%, P: up to 0.1%, Al: up to 1.5%, S: up to 0.01%, N: up to 0.1%, and optionally one or more elements from the group of rare earth metals, Mo, Cr, Zr, V, W, Co, Ni, B, Cu, Ca, with rare earth metals: up to 0.2%, Mo: up to 1%, Cr: up to 3%, Zr: up to 1%, V: up to 1%, W: up to 1%, Co: up to 1%, Ni: up to 2%, B: up to 0.1%, Cu: up to 3%, Ca: up to 0.015%, the balance being iron and unavoidable impurities; casting the steel melt to give a preliminary product; hot-rolling the preliminary product to give a hot strip, where the hot rolling end temperature is 820-1000° C.; coiling the hot strip to give a coil, where the coiling temperature is in the range from room temperature to 750° C.; annealing the hot strip at an annealing temperature of more than 530° C. and up to 950° C. over an annealing time of 1-50 hours; cold-rolling the annealed hot strip to give a cold-rolled flat steel product in one or more stages with a total cold rolling level of at least 45%; finally annealing the cold-rolled flat steel product at a final annealing temperature of 650-920° C. over an annealing time of 30-1500 seconds; and applying a metal anticorrosion layer based on zinc by means of electrolytic galvanization or hot dip galvanization of the cold-rolled and finally annealed flat steel product.

According to an aspect of the disclosure, the objective can be achieved by a cold-rolled, finally annealed and coated flat steel product. The flat steel product contains in addition to iron and unavoidable impurities (in % by wt.): C: 0.01-0.35%, Mn: 1-4%, Si: 0.5-2.5%, Nb: up to 0.2%, Ti: up to 0.2%, P: up to 0.1% Al: up to 1.5%, S: up to 0.01% N: up to 0.1% and optionally one or more elements from the group of rare earth metals, Mo, Cr, Zr, V, W, Co, Ni, B, Cu, Ca, with rare earth metals: up to 0.2%, Mo: up to 1%, Cr: up to 3%, Zr: up to 1%, V: up to 1%, W: up to 1%, Co: up to 1%, Ni: up to 2%, B: up to 0.1%, Cu: up to 3%, Ca: up to 0.015%. The cold-rolled and finally annealed flat steel product contains an Si enrichment layer between a surface and a base material of the cold-rolled and finally annealed flat steel product that has a depth between 10 nm and 1 μm and has a maximum Si content higher by a factor between 3 and 8 than the Si content of the base material. Further, the cold-rolled and finally annealed flat steel product has been coated with a metallic anticorrosion layer based on zinc that has been produced by electrolytic galvanization or hot dip galvanization of the cold-rolled and finally annealed flat steel product.

BRIEF DESCRIPTION OF THE DRAWINGS

In the drawings, like reference numerals designate corresponding similar parts. Embodiments are depicted in the drawings and are exemplarily detailed in the description which follows.

DETAILED DESCRIPTION

Figure 1:
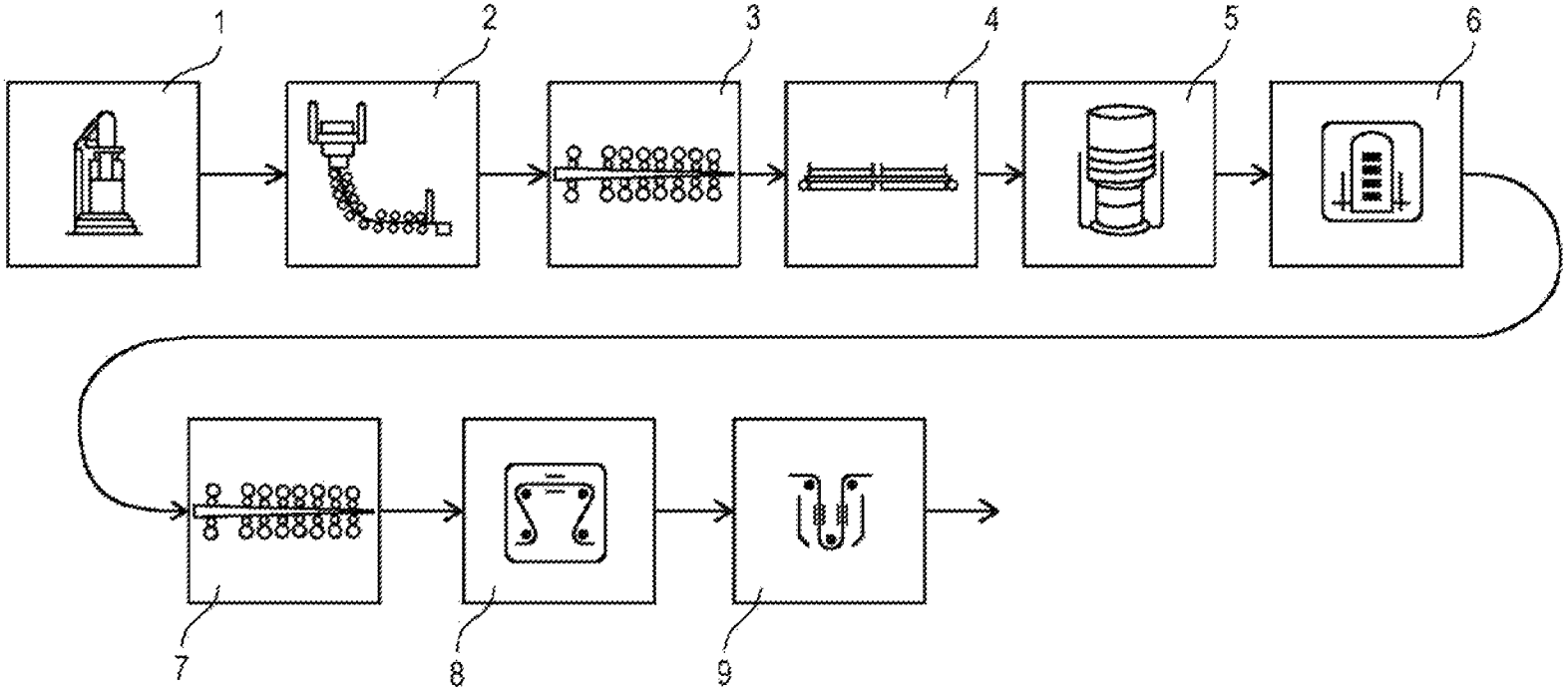
FIG. 1 is a schematic diagram showing a process sequence for the production of a flat steel product of the disclosure.

It has been recognized that an effective Si layer against diffusion of hydrogen into the metal lattice can be produced by a combination of measures relating both to the steel composition used and to the process regime (called the "route") for the production of the flat steel product.

A starting point for the inventive considerations was based on the finding that an input of hydrogen into the metal lattice can also take place to a considerable degree after the application of the anticorrosion layer (galvanization), especially in the downstream process steps of phosphation and cathodic dip coating. It is generally the eventual customer that performs these process steps, but these "subsequently" increase the hydrogen concentration in the metal lattice and hence the risk of delayed brittle fracture. Within this disclosure, it was found that, by a relatively high Si content of 0.5-2.0%, preferably 0.7-2.5%, and controlled performance of an intermediate annealing step (annealing of the hot strip) and a final annealing step on the cold-rolled flat steel product, a thin Si enrichment layer can be produced between a surface and the base material of the cold-rolled and finally annealed flat steel product, having a maximum Si content higher by a factor of between three and eight than the Si content of the base material, and having a depth between 10 nm and 1 μm, measured from the surface of the flat steel product.

This Si enrichment layer serves as an effective inhibition layer to counter the diffusion of atomic hydrogen into the metal lattice of the flat steel product. The layer minimizes the absorption of hydrogen in all electrical charging steps after production thereof, i.e. especially in the descaling, the electrolytic galvanization or optionally hot dip galvanization, and in the subsequent processing steps mentioned (phosphation, cathodic dip coating), which have not been given sufficient attention to date with regard to their importance for the intercalation of hydrogen into the metal lattice.

The annealing of the hot strip is preferably conducted at an annealing temperature of more than 550° C. and up to 730° C. The annealing of the (optionally pickled) hot strip produces a near-surface initial Si enrichment layer, the presence of which promotes the later near-surface increase in the Si content (Si enrichment layer), which is (only) achieved in the final annealing of the cold-rolled flat steel product.

The annealing of the hot strip is preferably conducted over an annealing time of 20-40 hours. It has been found that, with these annealing times, a suitable initial Si enrichment layer can be achieved when the abovementioned Si concentration is used in the flat steel product.

The minimum Si content of the initial Si enrichment layer may be 20% or more above the Si content of the base material of the flat steel product. In addition, the depth of the initial Si enrichment layer may be not more than 100 nm, especially 80 nm, very especially 50 nm, 30 nm, 20 nm or 10 nm, measured from the surface of the hot strip.

The final annealing of the cold-rolled flat steel product can be conducted over an annealing time of 60-900 seconds. Even in the case of a short annealing time between 60 and 180 seconds, for example, an Si enrichment layer is formed in the cold-rolled flat steel product between a surface and the base material of the cold-rolled and finally annealed flat steel product, which effectively inhibits subsequent inward hydrogen diffusion.

The maximum Si content of the Si enrichment layer may be higher by a factor between 3 and 8 than the Si content of the base material. Experiments have shown that an increase by a factor between 4 and 6 may preferably be provided. In addition, the depth of the Si enrichment layer may be not more than 1 μm, 500 nm, 300 nm, 100 nm, 80 nm, 50 nm, 30 nm or 20 nm, measured from the surface of the flat steel product.

The electrolytic galvanization of the cold-rolled and finally annealed flat steel product is effected with DC current. The use of AC current rather than DC current in the descaling step can reduce the absorption of atomic hydrogen into the metal lattice of the flat steel product. Alternatively, it is possible to undertake hot dip galvanization. A cold-rolled, finally annealed and coated flat steel product has the composition of elements specified above in relation to the method of the disclosure. Percentages based on material compositions in this document are always figures in % by weight.

Since the Si content of the base material of the flat steel product is required for the formation of the Si enrichment layer, the Si content is preferably between 0.7% and 2.5%, more preferably 0.8% and 2.0%, especially between 1.2% and 2.0%. The higher the Si content of the base material, the greater the maximum concentration of Si in the Si enrichment layer (with otherwise identical production parameters). As well as the layer production function, silicon also has the effect of binding oxygen in the course of casting of the steel.

Preferably, the C content of the flat steel product is between 0.15% and 0.25%. More particularly, the carbon content may be below the maximum limit of 0.23% envisaged for dual-phase steels. Carbon (C) in dissolved form considerably increases the hardenability of the steel and is thus indispensable for the formation of a sufficient amount of martensite, bainite or carbides. However, excessively high carbon contents increase the difference in hardness between ferrite and martensite, and reduce weldability.

Preferably, the Mn content is 2-3%. Manganese (Mn), through formation of solid solutions, increases the strength of the steel product. In the steel of the disclosure, it is possible to use relatively high Mn contents without adversely affecting the formation of the Si enrichment layer of the disclosure at the surface of the flat steel product.

Aluminum (Al) binds the oxygen and nitrogen dissolved in the iron. In addition, Al, like Si, shifts ferrite formation to shorter times and hence enables the formation of sufficient ferrite in the dual-phase steel. Another reason for conventional use of Al is to replace a portion of the Si since it is described as being less critical for the galvanization reaction than silicon. Since, however, comparatively high Si contents are envisaged in accordance with the disclosure, Al can preferably be used only in low concentrations below 1.0%, 0.5%, especially below 0.1%.

Advantageous compositions further relate to relatively low concentrations of the metals niobium (Nb), titanium (Ti), chromium (Cr), cobalt (Co), nickel (Ni) and/or copper (Cu). The following contents may be provided: Nb: up to 0.1%, especially up to 0.05%, Ti: 0.005 to 0.1%, especially 0.03-0.08%, Cr: up to 0.1%, Co: up to 0.1%, Ni: up to 0.1% and/or Cu: up to 0.1%.

The process steps set out hereinafter with reference to FIG. 1 are merely illustrative and can be replaced or supplemented by other or similar process steps. More particularly, further processes that will not be discussed in detail in this description may be present between the process steps described hereinafter.

The starting point in steel production is a blast furnace process 1 in which a steel melt is produced.

After an aftertreatment of the steel not shown in FIG. 1 (secondary metallurgy), the steel melt has a composition within the ranges specified above.

This is followed by casting 2 of the steel, by which preliminary products, for example what are called rolled billets, are produced.

Optionally, after the casting, through-heating or holding of the preliminary products at a preheating temperature of 1000-1300° C., preferably 1150-1250° C., may be envisaged.

The preliminary products produced (and optionally preheated) in the casting 2 of the steel melt (for example strand casting) are subsequently hot-rolled at a rolling station 3. The hot rolling is effected at a rolling end temperature between 820-1000° C., preferably 840-920° C.

After the production of the hot strip, it is optionally possible to perform pickling of the hot strip at station 4. The pickling removes the surface oxides that have formed as a result of the hot rolling, which could likewise have an inhibiting effect with regard to absorption of hydrogen.

After the hot rolling and optionally the pickling of the hot strip, the hot strip is coiled to a coil at station 5. The coiling temperature may vary over a wide range and may be, for example, from room temperature up to about 750° C., preferably 450 to 700° C.

The hot strip that has been wound to a coil is then annealed, i.e. heated once again. The annealing of the hot strip is conducted at a hot strip annealing station 6 on the wound coil at an annealing temperature of more than 530° C. and up to 950° C., preferably 550° C. to 650° C. The annealing time is in the range from 1 to 50 hours, preferably 20 to 40 hours.

The hot strip annealing is preferably conducted by bell annealing, by means of which the comparatively long annealing times and a homogeneous temperature distribution can be achieved in a cost-efficient manner.

The annealing of the hot strip is a process step necessary for the later formation of the Si enrichment layer of the disclosure. As is yet to be elucidated hereinafter, it has been found that, in the hot strip annealing, an initial Si enrichment layer is (first) produced close to the surface of the hot strip, which is required for the later Si redistribution close to the surface to form the thin, hydrogen diffusion-inhibiting Si enrichment layer.

The Si enrichment in near-surface regions of the hot strip to form the initial Si enrichment layer depends both on the annealing time and on the annealing temperature in the hot strip annealing operation. The hot strip annealing temperature may especially be equal to or greater than or less than 550° C., 600° C., 650° C., 700° C., 750° C., 800° C., 850° C. or 900° C. The annealing time may especially be equal to or less than or greater than 5 hours, 10 hours, 15 hours, 20 hours, 24 hours, 30 hours, 35 hours, 40 hours or 45 hours.

In the process route beyond the annealing of the hot strip, at a rolling station 7, the annealed hot strip is cold-rolled. The total cold rolling level may be at least 45% or higher, for example equal to or greater than 50%, 55%, 60% or 65%.

After the cold rolling, the cold-rolled flat steel product is finally annealed at a final annealing temperature between 650° C. to 920° C. The final annealing is conducted at a final annealing station 8, for example a tunnel annealing furnace. In particular, the final annealing step can be conducted at a temperature equal to or greater than or less than 700° C., 750° C., 800° C., 850° C. or 900° C.

The annealing time of the final annealing step is between 30 and 1500 seconds (s). The annealing time of the final annealing step may especially be between 60 s and 900 s, although it is also possible to choose annealing times of equal to or less than or greater than 120 s, 180 s, 240 s or 300 s.

The final annealing step can firstly achieve recrystallization of the flat steel product. Secondly, in the case of a flat steel product having the composition of the disclosure and the process sequence of the disclosure, especially the required annealing of the hot strip at the hot strip annealing station 6, a (final) Si enrichment layer forms between a surface and a base material of the cold-rolled and finally annealed flat steel product. The depth of the Si enrichment layer, measured from the surface of the flat steel product, is between 10 nm and 1 μm. Depth profiles of the Si enrichment layer are considered in detail later on in connection with FIG. 4. Where reference is made to "Si enrichment layer" hereinafter, this always means the final Si enrichment layer after the final annealing.

After the final annealing step to form the near-surface or surface adjacent Si enrichment layer, the cold-rolled and finally annealed flat steel product is coated with a metallic anticorrosion layer based on zinc.

According to the disclosure, the galvanization can be effected by means of an electrolytic galvanization process (ELO) at an electrolytic galvanization station 9. The actual electrolytic coating process is preceded by a pretreatment (not shown) of the flat steel product. The pretreatment may include various mechanical cleaning steps, for example brush degreasing and the like. In addition, an electrolytic descaling step is typically conducted, including an anodic iron solution and residue removal. In the electrolytic descaling step, which can be conducted with AC current, for example, there is already a cathodic charging reaction that brings about an elevated risk of absorption of hydrogen into the metal lattice.

The electrolytic descaling step is followed by the actual galvanization of the flat steel product in the electroplating system present at the galvanization station 9. The galvanization can be effected on one or both sides. It can be conducted on a continuous steel strip at a treatment speed, for example, of 10 to 200 m/min, preferably 80 to 140 m/min.

The process of galvanization also results in a cathodic charging reaction that can result in absorption of hydrogen into the metal lattice. In the case of conventional flat steel products without the inventive formation of an Si enrichment layer at the surface of the flat steel product, it has been found that, in the electrolytic galvanization, according to the mode of plant operation, up to 0.3 ppm of diffusible hydrogen (measured isothermally at 350° C.) may be absorbed into the metal lattice.

As an alternative to electrolytic galvanization, hot dip galvanization is also possible.

The actual galvanization (electroplating or hot dip galvanization) is generally followed by an aftertreatment of the galvanized flat steel product, which is not shown in FIG. 1 and may comprise, for example, phosphation, passivation and/or oiling of the flat steel product. These process steps may also entail further loading with hydrogen and the risk of penetration thereof into the metal lattice of the flat steel product.

The absorption of hydrogen in the galvanization (pretreatment, electroplating or hot dip galvanization, aftertreatment) should be as low as possible since the covering zinc layer distinctly reduces the later effusion of hydrogen. However, it has been recognized that, in spite of the zinc layer, it is also possible as a result of subsequent customer processing steps that subsequent absorption of hydrogen into a (galvanized) steel strip can occur. For example, in cathodic dip coating application and in any phosphation that takes place once again on the part of the customer, processes that enable penetration of hydrogen into the metal lattice are likewise conducted. In the case of a dwell time of about 10 minutes in a dip coating pretreatment and in a cathodic electrocoating bath, in a flat steel product without the Si enrichment layer, an absorption of hydrogen of up to 0.2 ppm (at a heating rate of 20 K/s to 900° C.) into the metal lattice was measured.

FIGS. 2 to 5 illustrate the inventive formation of a surface-adjacent or near-surface Si enrichment layer for inhibition or retardation of the diffusion of hydrogen into the base metal of the flat steel product.

Figure 2:
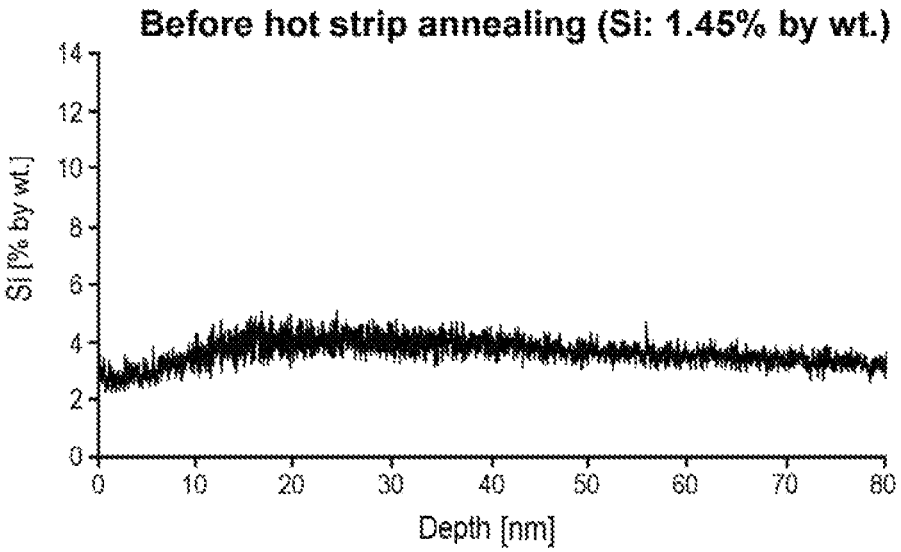
FIG. 2 is a chart showing the Si content in the flat steel product before the hot strip annealing depending on the distance from the surface of the flat steel product for a base material having an Si content of 1.45%.

FIG. 2 shows the silicon profile (in % by wt.) depending on depth measured from the surface of the hot strip prior to the hot strip annealing operation. The Si content of the hot strip (or of the steel melt from which the hot strip is produced) was 1.45%. FIG. 2 shows that a comparatively constant or uniform silicon profile with respect to depth is present. More particularly, FIG. 2 shows the condition of the hot strip after the pickling 4 and documents that prior annealing on the process route does not cause any Si enrichment at the surface of the pickled hot strip.

Figure 3:
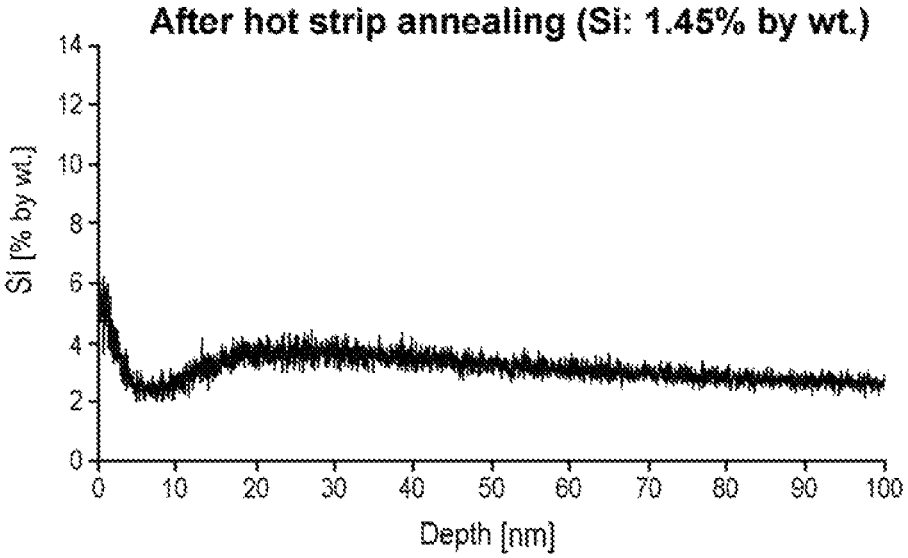
FIG. 3 is a chart showing the Si content in the flat steel product after the hot strip annealing and before the cold rolling operation depending on the distance from the surface of the flat steel product for a base material having an Si content of 1.45%.

FIG. 3 shows the progression of the Si content (silicon profile) after the hot strip annealing operation. The Figure makes it clear that a significant initial Si enrichment layer was produced between the surface and a base material of the annealed hot strip. It has been found that a maximum Si content of the initial Si enrichment layer is, for example, 20% or more above the Si content of the base material. The initial Si enrichment layer in the example shown here has a layer thickness of about 10 nm, measured from the surface. It has been found that layer thicknesses equal to or less than 100 nm, 80 nm, 50 nm, 40 nm, 30 nm or 20 nm are possible.

Figure 4:
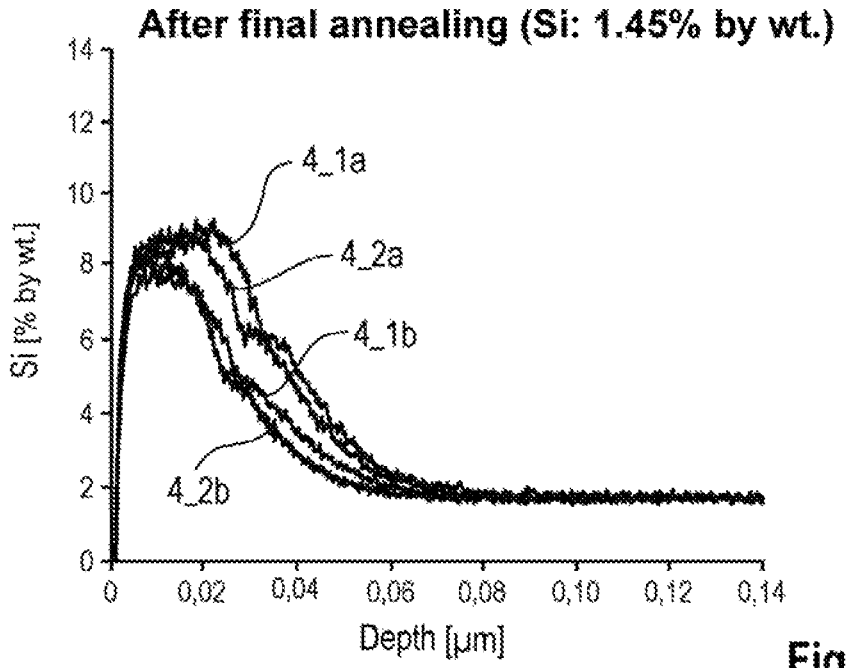
FIG. 4 is a chart showing the Si content in the flat steel product of the finished material (i.e. after the final annealing) depending on the distance from the surface of the flat steel product for a base material having an Si content of 1.45%.

FIG. 4 shows the silicon profile (progression of the Si content) in the finished material, i.e. after the final annealing of the cold-rolled flat steel product. What are shown are the silicon profiles of two flat steel products with an identical Si content of 1.45%, with curves 4_1*a* and 4_1*b* relating to a first flat steel product measured from the top side (index a) and from the bottom side (index b), and curves 4_2*a* and 4_2*b* denoting a second flat steel product, on which measurements were likewise taken on the top side (index a) and on the bottom side (index b). It is apparent that, in all cases, distinct formation of an Si enrichment layer took place close to the surface. The Si enrichment layer may have a greater depth than the initial Si enrichment layer. The depth of the Si enrichment layer in the examples shown here is about 0.06 μm (i.e. 60 nm), although it is possible either for greater layer thicknesses, for example equal to or less than 500 nm, 300 nm, 200 nm, 150 nm, 100 nm, 80 nm, or else smaller layer thicknesses equal to or less than 50 nm, 30 nm or 20 nm, to occur.

FIG. 4 shows that an enrichment of the Si content by a factor of more than 4 compared to the Si content of the base material is possible. The maximum Si content of the Si enrichment layer may be greater, for example, by a factor of 3, 4, 5, 6, 7 or 8 than the Si content of the base material of the cold-rolled and finally annealed flat steel product. The Si enrichment layer may have a greater Si enrichment factor (ratio of maximum Si content and Si content of the base material) than the initial Si enrichment layer.

Figure 5:
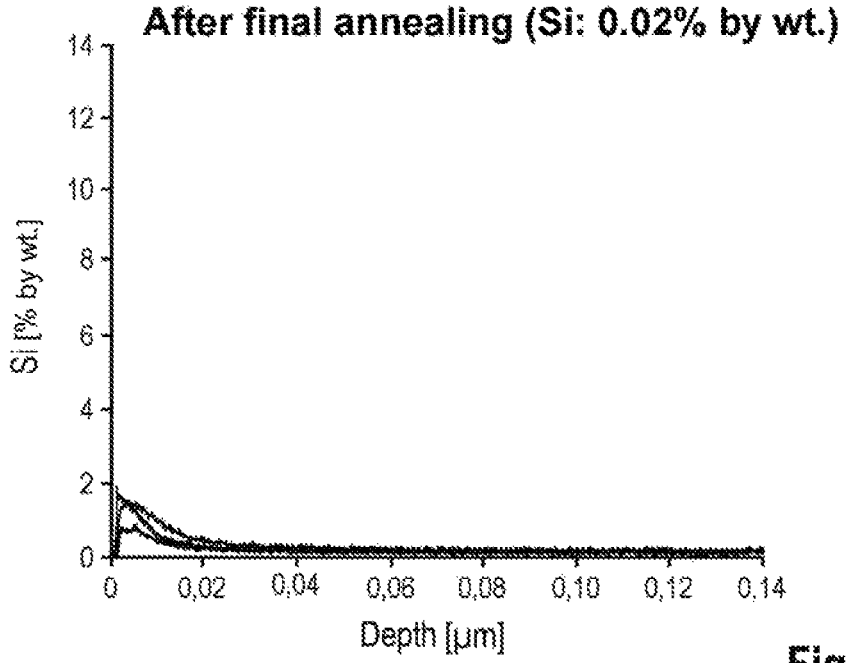
FIG. 5 is a chart showing the Si content in the flat steel product of the finished material (i.e. after the final annealing) depending on the distance from the surface of the flat steel product for a base material having an Si content of 0.02%.

FIG. 5 shows, by way of example, the silicon profile of a material having an Si content of less than 0.02% in the finished material, i.e. after the final annealing as in FIG. 4. FIG. 5 illustrates that, in the case of this noninventive material, no effective Si enrichment layer is formed since the Si concentration in the base material is obviously not sufficiently high for the purpose.

Figure 6:
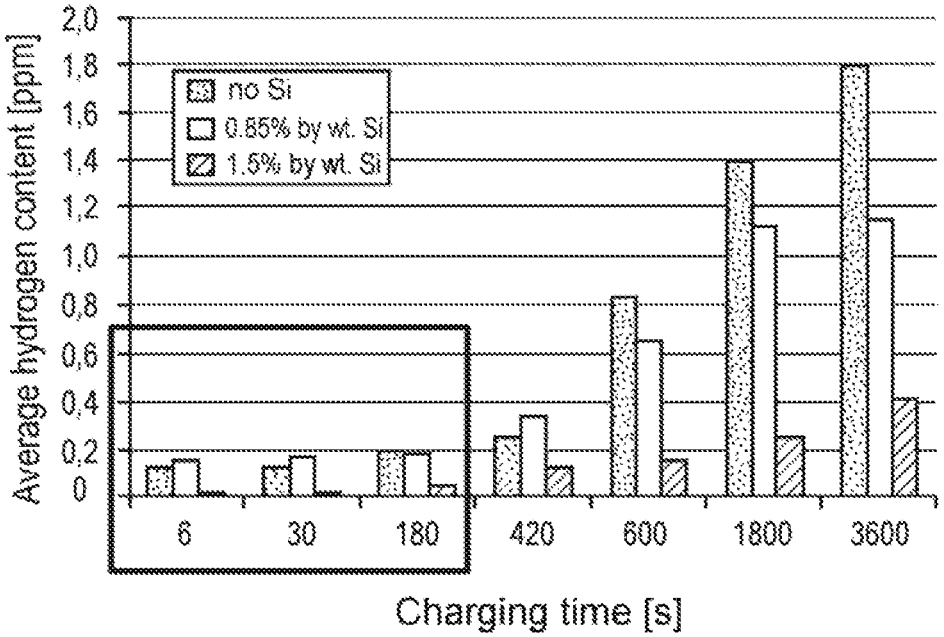
FIG. 6 is a chart showing the absorption of hydrogen in the course of performance of a descaling step in electrolytic galvanization depending on the duration of the descaling step for a flat steel product having different Si contents.

FIG. 6 documents the efficacy of the solution in accordance with the disclosure. The average hydrogen content in the metal lattice in ppm is plotted against the charging time in the descaling step, which, as already described above, is performed in the electrolytic galvanization in the galvanization plant 9. The measurements were conducted on flat steel products having different Si contents (no Si, 0.85% Si, 1.5% Si).

FIG. 6 shows that the absorption of hydrogen generally increases with rising charging time. This is true both of charging times in the range from 6 to 180 seconds, which are realistic durations in practice (the particular aim is short charging times between 6 and 100 seconds, if possible shorter than 80, 60, 40, 20 seconds), and of longer charging times, in the case of which the hydrogen input into the metal lattice continues to increase continuously. FIG. 6 illustrates that, in the process regime chosen here, an Si content of 0.85% does not effectively prevent the absorption of hydrogen for shorter charging times, whereas, in the case of longer charging times, even this relatively low Si content distinctly inhibits the ingress of diffusible hydrogen into the metal lattice. Meanwhile, the Si enrichment layer formed at an Si content of 1.5% enables very effective suppression of the absorption of hydrogen in the descaling step even in the case of relatively short charging times.

It is pointed out that the layer thickness of the Si enrichment layer in the finished material cannot be dependent solely on the Si content, but also on the process regime in the production of the flat steel product, especially on the process regime in the hot strip annealing operation and on the process regime in the final annealing of the cold-rolled flat steel product. In this respect, an Si content of 0.85% which is relatively low in the context of the disclosure, possibly even in the case of relatively short charging times, can show a certain efficacy against the penetration of hydrogen. FIG. 6 secondly shows that, at least in the case of higher Si contents, the efficacy of the Si enrichment layer of the disclosure increases significantly—and especially also in the case of short charging times. In this respect, the Si content may preferably be equal to or greater than 0.5%, 0.6%, 0.7%, 0.8%, 0.9%, 1.0%, 1.1%, 1.2%, 1.3%, 1.4%, 1.5%, 1.6%, 1.7%, 1.8% or 1.9%.

Although FIG. 6 relates to the charging time in the descaling step, it can be assumed that similar behavior will occur in other processes in which loading with hydrogen likewise occurs. This means that the Si enrichment layer of the disclosure can effectively delay or inhibit the ingress of hydrogen into the metal lattice in other charging processes as well.

Figure 7:
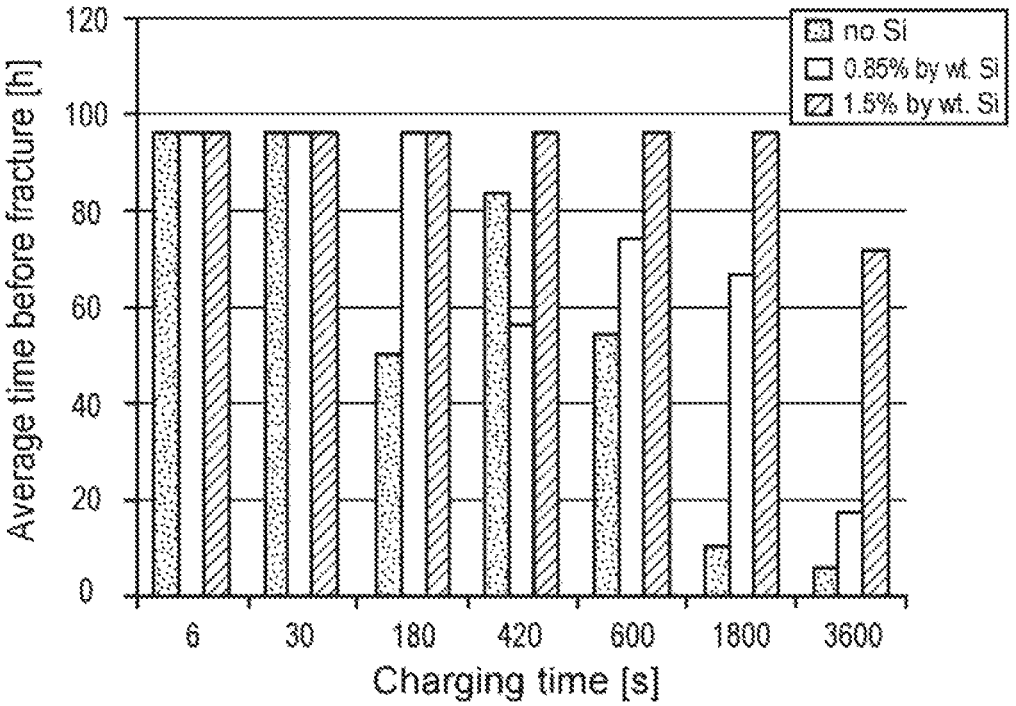
FIG. 7 is a chart showing the average time before fracture of a flat steel product against a charge application time in the course of descaling for different Si contents of a flat steel product.

FIG. 7 likewise serves to illustrate the efficacy of the solution of the disclosure described here. What is shown is the average duration before fracture of a flat steel product sample in hours (h) versus the charging time in seconds (s). The chart illustrates that, in the case of relatively short charging times of 6 and 30 seconds, there is still no influence (at the load durations in question) on the fracture characteristics of the flat steel product samples. In the case of higher charging times over and above 180 seconds or more, it is found that the flat steel product sample having an Si enrichment layer based on an Si content of 1.5% shows significantly better fracture resistance than the comparative samples. As already described, this is attributable to the barrier effect of the Si enrichment layer with respect to the ingress of diffusible hydrogen into the metal lattice.

The efficacy of the Si enrichment layer of the disclosure with respect to charging processes in the course of electrolytic galvanization (especially in the descaling step) has been shown. As already mentioned, in spite of the protective effect of the zinc layer, it is also possible in downstream customer processes for additional significant absorption of hydrogen into the steel to take place. It is therefore assumed that the protective properties of the thin Si enrichment layer shown in FIGS. 6 and 7 are also effective in downstream customer processes. The Si enrichment layer of the disclosure thus also enables protection of the galvanized flat steel product from hydrogen-induced cracking owing to charging processes that take place outside the scope of influence of the steel manufacturer.

Figure 8:
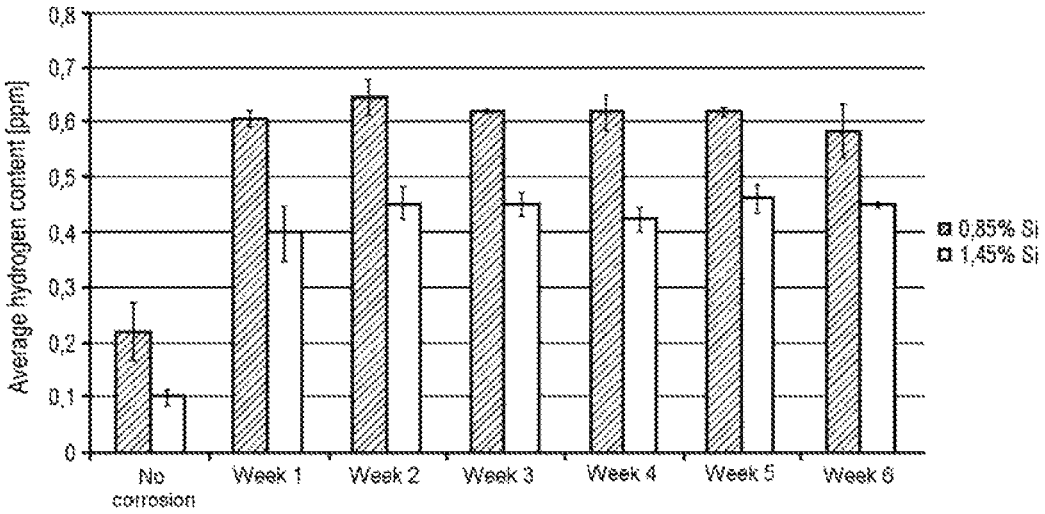
FIG. 8 is a chart in which the average hydrogen content in a corrosion test is plotted against corrosion times of 0 to 6 weeks for a stretched flat steel product for different Si contents.

This is illustrated by FIG. 8. FIG. 8 shows the average hydrogen content (in ppm) in the VDA 233-102 cyclical corrosion test on galvanized samples that have been prestretched to uniform elongation over corrosion times of 0 to 6 weeks. The VDA 233-102 test can be used to ascertain the corrosion characteristics of materials and components, and corrosion protection by coating systems, by an accelerated test method. In other words, the VDA 233-102 corrosion test simulates the corrosion characteristics of galvanized and stretched steels corresponding to the samples as used in the automotive industry, for example. It is apparent that the samples having a higher Si content show a reduced absorption of hydrogen, even after a relatively long period. After the first week of corrosion in the test, no further significant absorption of hydrogen seems to take place.

EXAMPLES

Table 1 shows steel compositions (alloys) No. 1 to 6. Alloys 1 to 5 are alloys of the disclosure, whereas alloy 6 is not in accordance with the disclosure owing to excessively low Si content. The residual content in all cases consists of iron and the unavoidable impurities, and possibly also of aforementioned optional elements.

TABLE 1

| | C | Mn | Si | Nb | Ti | P | S | Al | N |
|---|---|---|---|---|---|---|---|---|---|
| Alloy 1 | 0.19 | 2.3 | 1.45 | 0.002 | 0.003 | 0.009 | 0.003 | 0.04 | 0.0037 |
| Alloy 2 | 0.2 | 2.25 | 0.9 | 0.003 | 0.002 | 0.008 | 0.002 | 0.045 | 0.0048 |
| Alloy 3 | 0.18 | 2.35 | 2.0 | 0.02 | 0.005 | 0.009 | 0.0025 | 0.04 | 0.0045 |
| Alloy 4 | 0.19 | 2.4 | 1.7 | 0.03 | 0.004 | 0.008 | 0.002 | 0.045 | 0.0050 |
| Alloy 5 | 0.2 | 2.55 | 1.2 | 0.03 | 0.002 | 0.007 | 0.0025 | 0.04 | 0.0045 |
| Alloy 6 | 0.18 | 2.55 | 0.3 | 0.02 | 0.003 | 0.007 | 0.0025 | 0.05 | 0.0043 |

All values are stated in % by weight.

Table 2 shows process parameters and hydrogen absorption for the steel compositions (alloys) No. 1 to 6.

TABLE 2

| | H (ppm) | Hot strip annealing temp. ° C. | Total annealing time H | Final annealing temp. ° C. | Inventive |
|---|---|---|---|---|---|
| Alloy 1 | 0.05 | 590 | 33 | 845 | Yes |
| Alloy 2 | 0.09 | 600 | 32 | 850 | Yes |
| Alloy 3 | 0.04 | 580 | 33.5 | 848 | Yes |
| Alloy 4 | 0.07 | 600 | 33 | 850 | Yes |
| Alloy 5 | 0.09 | 590 | 32.5 | 847 | Yes |
| Alloy 6 | 0.22 | 590 | 32 | 847 | No |

The total annealing time corresponds to the sum total of the annealing time of the hot strip and the annealing time in the final annealing, although, owing to the significantly longer hot strip annealing times, the total annealing times stated can also be interpreted approximately as (upper limits of the) hot strip annealing time.

Table 2 makes it clear that the hydrogen absorption H (measured isothermally at 350° C.) for the steel compositions or flat steel products of the disclosure (alloys 1 to 5) is significantly smaller (for example always below 0.1 ppm) than for the noninventive alloy 6. It is also found that alloy 3 having the greatest Si content has the smallest hydrogen absorption.

The invention claimed is:

1. A method of producing a cold-rolled flat steel product coated with a metallic anticorrosion layer, the method comprising:

producing a steel melt containing in addition to iron and unavoidable impurities (in % by wt.)

C: 0.01-0.35%,

Mn: 2-4%,

Si: 0.5-2.5%,

Nb: up to 0.2%,

Ti: up to 0.2%,
P: up to 0.1%,
Al: up to 1.5%,
S: up to 0.01%,
N: up to 0.1%,
Mo: up to 1%,
Cr: up to 3%,
Zr: up to 1%,
V: up to 1%,
W: up to 1%,
Co: up to 1%,
Ni: up to 2%,
B: up to 0.1%,
Cu: up to 3%, and
Ca: up to 0.015%, casting the steel melt to give a preliminary product;

hot-rolling the preliminary product to give a hot strip, where the hot rolling end temperature is 820-1000° C.;

coiling the hot strip to give a coil, where the coiling temperature is in the range from room temperature to 750° C.;

annealing the hot strip at an annealing temperature of more than 530° C. and up to 950° C. over an annealing time of 24-50 hours;

cold-rolling the annealed hot strip to give a cold-rolled flat steel product in one or more stages with a total cold rolling level of at least 45%;

finally annealing the cold-rolled flat steel product at a final annealing temperature of 650-920° C. over an annealing time of 240-1500 seconds, the final annealing of the cold-rolled flat steel product generating an Si enrichment layer between a surface and a base material of the cold-rolled and finally annealed flat steel product, the maximum Si content of which is higher by a factor between 3 and 8 than the Si content of the base material, and which has a depth between 10 nm and 1 μm; and applying a metal anticorrosion layer based on zinc by electrolytic galvanization or hot dip galvanization of the cold-rolled and finally annealed flat steel product.

2. The method as claimed in claim 1, wherein the annealing of the hot strip is conducted at an annealing temperature of more than 550° C. and up to 730° C.

3. The method as claimed in claim 1, wherein the annealing of the hot strip is conducted over an annealing time of 30-50 hours.

4. The method as claimed in claim 1, wherein the annealing of the hot strip generates an initial Si enrichment layer between a surface and a base material of the annealed hot strip.

5. The method as claimed in claim 4, wherein a minimum Si content of the initial Si enrichment layer is 20% or more above the Si content of the base material.

6. The method as claimed in claim 4 , wherein the initial Si enrichment layer has a depth of not more than 100 nm, 80 nm, 50 nm, 30 nm or 20 nm.

7. The method as claimed in claim 1, wherein the final annealing of the cold-rolled flat steel product is performed over an annealing time of 240 to 900 seconds.

8. The method as claimed in claim 1, further comprising:

through-heating or keeping the preliminary product at a preheating temperature of 1000-1300° C. between the casting and the hot rolling.

9. The method as claimed in claim 1, further comprising:

pickling the hot strip between the coiling and the annealing of the hot strip.

10. The method as claimed in claim 1, wherein the cold-rolled and finally annealed flat steel product is descaled with alternating current.

11. A cold-rolled, finally annealed and coated flat steel product, wherein the flat steel product contains in addition to iron and unavoidable impurities (in % by wt.):

C: 0.01-0.35%,
Mn: 2-4%,
Si: 0.5-2.5%,
Nb: up to 0.2%,
Ti: up to 0.2%,
P: up to 0.1%
Al: up to 1.5%,
S: up to 0.01%,
N: up to 0.1%,
Mo: up to 1%,
Cr: up to 3%,
Zr: up to 1%,
V: up to 1%,
W: up to 1%,
Ni: up to 2%,
B: up to 0.1%,
Cu: up to 3%, and
Ca: up to 0.015%, the cold-rolled, finally annealed and coated flat steel product is produced by casting the steel melt to give a preliminary product;

hot-rolling the preliminary product to give a hot strip, where the hot rolling end temperature is 820-1000° C.;

coiling the hot strip to give a coil, where the coiling temperature is in the range from room temperature to 750° C.;

annealing the hot strip at an annealing temperature of more than 530° C. and up to 950° C. over an annealing time of 24-50 hours;

cold-rolling the annealed hot strip to give a cold-rolled flat steel product in one or more stages with a total cold rolling level of at least 45%; and finally annealing the cold-rolled flat steel product at a final annealing temperature of 650-920° C. over an annealing time of 240-1500 seconds, and wherein the cold-rolled and finally annealed flat steel product contains an Si enrichment layer between a surface and a base material of the cold-rolled and finally annealed flat steel product that has a depth between 10 nm and 1 μm and has a maximum Si content higher by a factor between 3 and 8 than the Si content of the base material, and has been coated with a metallic anticorrosion layer based on zinc that has been produced by electrolytic galvanization or hot dip galvanization of the cold-rolled and finally annealed flat steel product.

12. The cold-rolled, finally annealed and coated flat steel product as claimed in claim 11, wherein the Si enrichment layer has a depth of not more than 500 nm, 300 nm, 100 nm, 80 nm, 50 nm, 30 nm or 20 nm.

13. The cold-rolled, finally annealed and coated flat steel product as claimed in claim 11, wherein a maximum Si content of the Si enrichment layer is higher by a factor between 4 and 6 than the Si content of the flat steel product in the region of the base material.

14. The cold-rolled, finally annealed and coated flat steel product as claimed in claim 11, wherein Si: 0.6-2.0%.

15. The cold-rolled, finally annealed and coated flat steel product as claimed in claim 11, wherein

C: 0.15-0.25%.

16. The cold-rolled, finally annealed and coated flat steel product as claimed in claim 11, wherein Mn: 2.25-3%.

17. The cold-rolled, finally annealed and coated flat steel product as claimed in claim 11, wherein Nb: up to 0.1% and/or Ti: 0.001-0.1% and/or Al: up to 0.5%.

18. The cold-rolled, finally annealed and coated flat steel product as claimed in claim 11, wherein Cr: up to 0.1% and/or Co: up to 0.1% and/or Ni: up to 0.1% and/or Cu: up to 0.1%.

19. The method as claimed in claim 1, wherein finally annealing the cold-rolled flat steel product is carried out over an annealing time of 300-1500 seconds.

20. The cold-rolled, finally annealed and coated flat steel product as claimed in claim 11, wherein finally annealing the cold-rolled flat steel product is carried out over an annealing time of 300-1500 seconds.

* * * * *